US005832955A

United States Patent [19]

Schrey

[11] Patent Number: 5,832,955

[45] Date of Patent: Nov. 10, 1998

[54] METHOD FOR DETECTING VALVE PLAY IN A CYLINDER VALVE ACTUATED BY AN ELECTROMAGNETIC ACTUATOR

[75] Inventor: Ekkehard Schrey, Aachen, Germany

[73] Assignee: FEV Motorentechnik GmbH & Co KG, Aachen, Germany

[21] Appl. No.: 698,233

[22] Filed: Aug. 14, 1996

[30] Foreign Application Priority Data

Aug. 26, 1995 [DE] Germany ..... 195 31 437.9

[51] Int. Cl.[6] ..... F16K 37/00; F16K 31/06

[52] U.S. Cl. ..... 137/551; 251/129.1; 123/90.11

[58] Field of Search ..... 137/551; 251/129.1; 123/90.11; 73/116, 119 R; 33/611; 324/207.24

[56] References Cited

U.S. PATENT DOCUMENTS

| | | | |
|---|---|---|---|
| 4,841,923 | 6/1989 | Buchl | 251/129.1 X |
| 5,009,389 | 4/1991 | Kawamura | 251/129.1 |
| 5,131,624 | 7/1992 | Kreuter et al. | 251/129.1 X |
| 5,199,392 | 4/1993 | Kreuter et al. | 251/129.1 X |
| 5,311,903 | 5/1994 | Poulin | 251/129.1 X |
| 5,350,153 | 9/1994 | Morinigo et al. | 251/129.1 X |
| 5,548,263 | 8/1996 | Bulgatz et al. | 251/129.1 X |
| 5,644,280 | 7/1997 | Wilson et al. | 251/129.1 X |

*Primary Examiner*—John Rivell
*Attorney, Agent, or Firm*—Spencer & Frank

[57] ABSTRACT

A method is provided for detecting play between a cylinder valve of a piston engine and an electromagnetic actuator that actuates the cylinder valve. The electromagnet has a closing electromagnet and an opening electromagnet, two restoring springs and an armature which is guided to be movable back and forth between the two electromagnets, in each case counter to a force of a respective one of the restoring springs for acting upon the cylinder valve. With the armature held at one of the electromagnets by a holding current $I_H$, a time interval $t_H$ after turnoff of the holding current $I_H$ at the holding electromagnet until the arrival of the armature at the other one of the electromagnets is measured, and the valve play is calculated by subtracting from the time interval $t_H$ a motion time $t_B$ predetermined by the spring-mass system, comprising the armature, valve body and restoring springs, and a sticking time $t_K$ during which the armature remains at the holding electromagnet after cutoff of the holding current.

2 Claims, 2 Drawing Sheets

I
CLOSING
$I_H$
$t_k$
$t_{VS}$

U
CLOSING

S
12

I
OPENING
$T_A$
$T_2$
$T_1$
$T_0$
$t_B$
$t_{mess}$
$t_H$

METHOD FOR DETECTING VALVE PLAY IN A CYLINDER VALVE ACTUATED BY AN ELECTROMAGNETIC ACTUATOR

CROSS-REFERENCE TO RELATED APPLICATIONS

This application claims the right of priority of application DE 195 31 437.9 filed in Germany on Aug. 26, 1995, the disclosure of which is incorporated herein.

BACKGROUND OF THE INVENTION

In piston-type internal combustion engines, the individual cylinder valves are each held in a closing position by a closing spring, so that the cylinder valve can be opened only counter to the force of the closing spring. To assure that the cylinder valve is also reliably closed, there is no fixed connection between the actuating means and the cylinder valve. Instead, a defined gap, known as valve play, is provided between the two components. This prevents the situation in which under various operating conditions, for example, from thermal expansion of the components, the valve either does not close correctly or is not properly operatively connected to the respective actuating means.

Electromagnetic actuators are known which actuate cylinder valves. Such actuators include a closing electromagnet and an opening electromagnet and an armature which is guided so as to be movable back and forth between the two electromagnets in each case counter to the force of a restoring spring. When one of the restoring springs forms the closing spring of the cylinder valve, the arrangement must be made so that when the valve is closed the armature rests against the pole face of the closing magnet. On the other hand, when the opening magnet is actuated the cylinder valve must be reliably opened in the desired way. If the armature were solidly connected to the valve, then under various operating conditions, for example, from thermal expansion if nothing else, the valve either does not close correctly, or the armature would not rest on the pole face of the closing magnet, as is the case in other actuators. Because of the closed type of construction of such electromagnetic actuators, there is practically no free access to the gap between the armature and the shaft of the cylinder valve that defines the valve play, making mechanical measurement practically impossible.

SUMMARY OF THE INVENTION

It is an object of the invention to create an "electrical" method for measuring the valve play in a cylinder valve that is actuated by an electromagnetic actuator.

The above and other objects are accomplished according to the invention by the provision of a method for detecting play between a cylinder valve of a piston engine and an electromagnetic actuator that actuates the cylinder valve, the electromagnet having a closing electromagnet and an opening electromagnet, two restoring springs and an armature which is guided to be movable back and forth between the two electromagnets, in each case counter to a force of a respective one of the restoring springs for acting upon the cylinder valve, the cylinder valve including a valve body, the method comprising the steps of: with the armature held at one of the electromagnets by a holding current $I_H$, measuring a time interval $t_H$ after turnoff of the holding current $I_H$ at the holding electromagnet until the arrival of the armature at the other one of the electromagnets; and calculating the valve play by subtracting from the time interval $t_H$ a motion time $t_B$ predetermined by a spring-mass system comprising the armature, valve body and restoring springs and a sticking time $t_K$ during which the armature remains at the holding electromagnet after cutoff of the holding current.

In this method, use is made of the recognition that the motion time $t_B$ of the valve is dependent practically only on the mass to be moved, or in this case the armature and the valve body itself, and on the spring stiffness of the applicable restoring springs. Moreover, the fact is exploited that when the opening motion of the valve is initiated, the actual valve play present is initially spanned by the armature alone, and only after the armature strikes the valve body must the armature and the mass of the valve body be accelerated by the associated restoring spring of the closing magnet. Moreover, the force of the restoring spring acts counter to the opening magnet.

It is thus possible to derive the valve play directly from the spanning time $t_{VS}$, that is, the time that the armature takes, after being released from the pole face of the holding electromagnet, to arrive at the valve body. The following equation applies:

$$t_{VS}=t_H-t_K-t_B.$$

The stroke time $t_H$ is measured from the turnoff of the holding current at the coil of the holding electromagnet until the arrival of the armature is detected at the coil of the capturing electromagnet. The sticking time $t_K$ is known from the design of the electromagnet, and the motion time $t_B$ is known from the specifications for of the mechanical spring-mass system.

The sticking time $t_K$, however, may be variable by external factors, including factors during operation. It is thus provided as a feature of the invention that to take into account the actual sticking time $t_K$, the actual separation time $T_2$ of the armature from the holding closing magnet is ascertained which denotes the onset of a measurement period $t_{mess}$. The separation time $T_2$ is detected, for instance, by detecting the course over time of the voltage at the coil of the holding electromagnet. Proceeding in this way advantageously utilizes the fact that after the turnoff of the holding current, there is a drop in the magnetic field of the holding electromagnet and a voltage rise is induced in the coil of the holding electromagnet. This voltage rise decreases with the decrease in the magnetic field. However, upon the actual separation of the armature from the pole face of the holding electromagnet, because of the varying inductance, a pronounced voltage change is brought about, which can then be utilized as a "starting signal" for the onset of the measuring time $t_{mess}$. The mathematical equation for detecting the time $t_{VS}$ that is definitive for determining the valve play is thus simplified and becomes the equation $$t_{VS}=t_B-t_{mess}.$$

Once again, it is a premise that the motion time of the spring-mass system formed by the armature, valve body and the restoring springs can be predetermined with adequate accuracy on the basis of the construction specifications. Since the construction specifications for the spring-mass system comprising the armature and the restoring springs are also known, the valve play itself can be derived directly from the ascertained time $t_{VS}$.

The method of the invention will now be described in further detail in conjunction with the accompanying drawings.

DETAILED DESCRIPTION OF THE PREFERRED EMBODIMENTS

Figure 1:
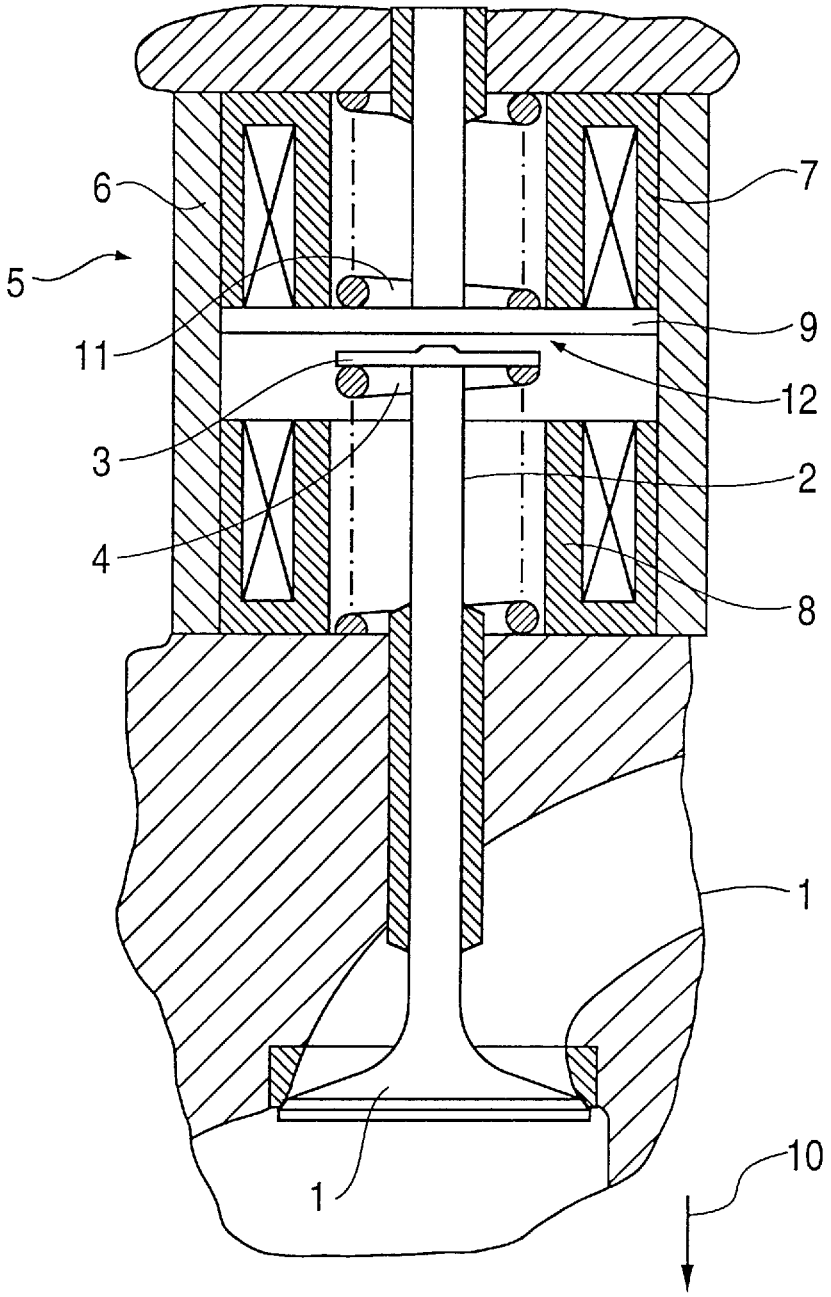
FIG. 1 is a cross section of a cylinder valve with an electromagnetic actuator utilized for implementing the method of the invention.

Referring to FIG. 1, there is shown a cylinder valve 1 having a valve stem 2 provided at one end with a profiled end piece 2' and at an opposite end with a valve plate 3 on which a closing spring 4 is supported that keeps cylinder valve 1 in a closing position as shown. Valve stem 2 together with valve plate 3 and profiled end piece 2' comprise a "valve body."

Cylinder valve 1 is assigned an electromagnetic actuator 5 which includes a housing 6 having two spaced-apart electromagnets including an upper electromagnet 7 representing a closing magnet and a lower electromagnet 8 representing an opening magnet. Disposed between the two electromagnets 7 and 8 is an armature 9, which is guided to be movable back and forth and is acted upon by a restoring spring 11 acting in an opening direction denoted by arrow 10 and a restoring spring 4 acting in an opposite, closing direction. When current is supplied to closing magnet 7, armature 9 rests, as shown, on the pole face of the closing magnet 7. Since the armature and the cylinder valve are not solidly connected to one another, it is now possible, by a displacement of closing magnet 7 inside housing 6 in the direction of motion of cylinder valve 1, to adjust a gap 12 which constitutes a valve play between armature 9 and valve plate 3. The size the valve play is approximately 0.6 mm, for instance. The size of the valve play is dimensioned such that different heat expansions in different operating states, for instance, will at no time lead to a situation in which a holding of armature 9 in the closing position causes the armature to touch valve plate 3 or even press the valve open.

If now the holding current at closing magnet 7 is turned off, armature 9 is moved by restoring spring 11 in direction 10 toward valve plate 3. Initially, restoring spring 11 needs to accelerate and move only the mass of armature 9. With the arrival of the armature at valve plate 3, not only must the mass of the valve body be accelerated, but at the same time the contrary force of closing spring 4 must also be overcome.

However, because of the electrical and electromagnetic events that occur upon turnoff of the holding current of closing magnet 7, the armature is not immediately set into motion, but instead there is a certain sticking time $t_k$. Therefore, the turnoff time cannot directly be made the basis for the onset of the actual armature motion. This sticking time $t_K$ must either be compensated for by calculation based on the known system specifications or compensated for by a suitable measurement.

Figures 2A, 2B, 2C, 2D:
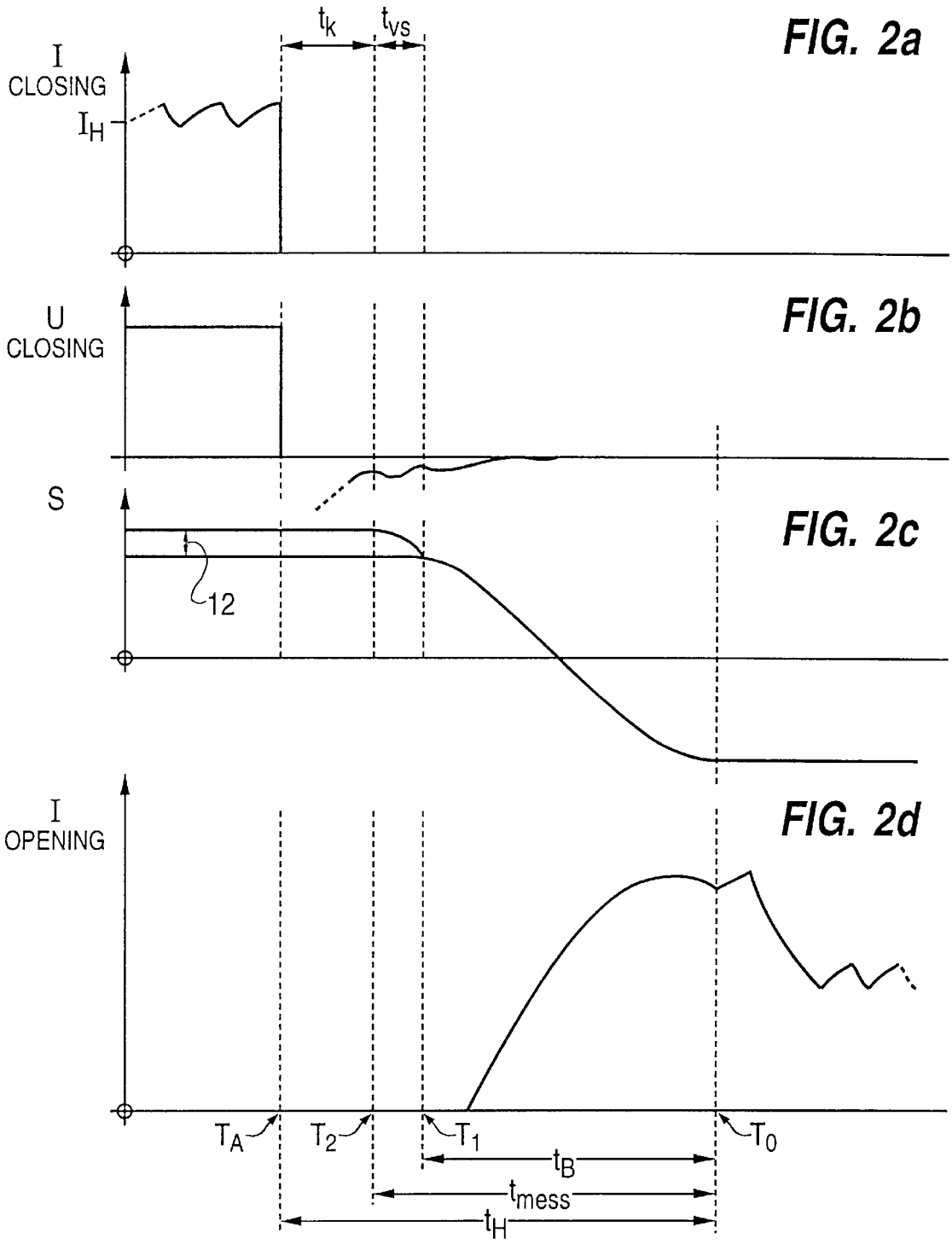
FIG. 2 is a diagram showing in interrelated graphs a), b), c) and d), the course over time of the current and voltage at the holding electromagnet, the armature stroke, and the current at the capturing magnet, respectively.

The course over time of the current and voltage at the holding closing magnet is shown in FIG. 2, graph a) for the current and graph b) for the voltage. Graph c) in FIG. 2 shows the stroke path of the armature and of the cylinder valve from the closing position into the opening position.

As shown in graph a), closing magnet 7 is acted upon by a clocked holding current $I_H$, until such time $T_A$ as the opening of the cylinder valve is to be initiated by a suitable control command. At time $T_A$, holding current $I_H$ is turned off. Correspondingly, the voltage at the coil of closing magnet 7 drops as well. Because of the inductive magnetic conditions, however, armature 9 cannot immediately separate from the pole face of closing magnet 7 but instead "sticks" for a certain period of time $t_K$ before it can come loose.

With the turnoff of holding current $I_H$, a contrary voltage builds up in the coil of closing magnet 7. The contrary voltage slowly decreases during the sticking time $t_K$ but rises suddenly again once the armature actually separates from the closing magnet. This voltage rise can be evaluated to detect the separation time. To that end, circuits which are known in principle, such as a differentiating element and a comparator followed by a gate circuit, can be used to demarcate the time period. If gap 12 that determines the valve play is present, as shown in FIG. 1 and in FIG. 2*c*, then after the separation from the pole face at time $T_2$, the mass of armature 9 alone moves, initially under the influence of the force of restoring spring 11, until armature 9 at time $T_1$ comes into contact with valve plate 3. Only from that time on does the mass of the armature and of the valve body of cylinder valve 1 have to be moved by restoring spring 11. This course of motion is shown in graph c) in FIG. 2. over a time interval $t_B$ between time $T_1$ and $T_0$. At time $T_0$, armature 9 comes to rest on the pole face of capturing opening magnet 8.

Motion time $t_B$ can be ascertained on the basis of the construction specifications of the spring-mass system formed by the armature and valve body and restoring springs. If sticking time $t_K$ is also known from the construction specifications of the closing magnet 7, then a time $t_{VS}$ that the armature alone requires to span the valve play defined by the gap 12 can be ascertained, by means of a simple measurement of a time period $t_H$ between time $T_A$, that is, the turnoff of the holding current, and the detection of the arrival of the armature at the capturing opening magnet at time $T_0$, taking the known times $t_K$ and $t_B$ into account. From this time measurement, the magnitude of the valve play can be derived directly, and a suitable adjusting step can thus be taken.

However, since sticking time $t_K$ can also vary as a result of operation-dictated factors, the conditions shown in FIG. 2 also allow one to proceed in a different way. On the basis of the voltage rise at time $T_2$, that is, the instant at which the armature 6 actually comes loose from the pole face of closing magnet 7, which voltage rise can again be ascertained after the turnoff time $T_A$, and thus a significant for this time is available, a measuring time $t_{mess}$ can thus be started as well, which lasts until time $T_0$, which is the time at which the contact of the armature with the opening magnet is detected. If the motion time $t_B$ defined by the spring-mass system is set in relation to the measured time $t_{mess}$, then from the difference one directly finds the motion time $t_{VS}$ that the armature requires to overcome the valve play defined by the gap 12. The magnitude of the valve play can be derived from this.

As the graph d) in FIG. 2 shows, the arrival of the armature at the pole face of the opening magnet can be derived for instance from the course over time that the opening magnet requires to build up the magnetic field. From the inductive changes that are effected by the approaching armature, the result is a pronounced current drop.

The signal for detecting the armature arrival can also be derived by other measurement provisions at the capturing opening magnet, for instance by detecting voltage changes or the like. Particularly, when a linearly regulated capturing current is employed, this is advantageous as the coil voltage exhibits a pronounced peak at the instant of arrival.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A method for detecting play between a cylinder valve of a piston engine and an electromagnetic actuator that actuates the cylinder valve, the electromagnet having a closing electromagnet and an opening electromagnet, two restoring springs and an armature which is guided to be movable back and forth between the two electromagnets, in each case counter to a force of a respective one of the restoring springs for acting upon the cylinder valve, the cylinder valve including a cylinder body, the method comprising the steps of:

with the armature held at one of the electromagnets by a holding current, measuring a time interval $t_H$ after turnoff of the holding current $I_H$ at the holding electromagnet until the arrival of the armature at the other one of the electromagnets; and calculating the valve play by subtracting from the time interval $t_H$ a motion time $t_B$ predetermined by the spring-mass system comprising the armature, valve body and restoring springs and a sticking time $t_K$ during which the armature remains at the holding electromagnet after cutoff of the holding current.

2. The method of claim 1, further including taking into account an actual sticking time $t_K$ by ascertaining a time $T_2$ at which the armature actually separates from the holding electromagnet, which denotes an onset of a time interval $t_{mess}$ where $t_{mess}=t_H-T_2$ and $t_K=t_H-t_{mess}$.

* * * * *